US005138955A

United States Patent [19]

Manner

[11] Patent Number: 5,138,955

[45] Date of Patent: Aug. 18, 1992

[54] MECHANISM FOR ADJUSTING THE TILT AND/OR HEIGHT OF A COUNTERTOP OR TABLE TOP OF FURNITURE

[75] Inventor: Roland Manner, Weilheim-Teck, Fed. Rep. of Germany

[73] Assignee: Robert Krause GmbH & Co. KG, Weilheim an der Teck, Fed. Rep. of Germany

[21] Appl. No.: 299,702

[22] Filed: Jan. 23, 1989

[30] Foreign Application Priority Data

Jan. 28, 1987 [DE] Fed. Rep. of Germany ..... 3702458
Jan. 20, 1988 [DE] Fed. Rep. of Germany ..... 3801403
Jan. 3, 1989 [DE] Fed. Rep. of Germany ... 8900023[U]

[51] Int. Cl.[5] ..... A47F 5/12
[52] U.S. Cl. ..... 108/1; 108/7
[58] Field of Search ..... 108/1, 4, 6, 7, 8, 10, 108/147; 248/396, 184

[56] References Cited

U.S. PATENT DOCUMENTS

| | | | |
|---|---|---|---|
| 859,907 | 7/1907 | Arnt | 108/4 |
| 862,943 | 8/1907 | Swart | 108/4 |
| 1,295,680 | 2/1919 | Benson | 108/8 X |
| 3,603,545 | 9/1971 | Boniface | 108/8 X |
| 4,615,279 | 10/1986 | de la Haye | 108/147 X |
| 4,947,763 | 8/1990 | Piorek | 108/8 |

FOREIGN PATENT DOCUMENTS

| | | | |
|---|---|---|---|
| 348853 | 5/1905 | France | 108/4 |

*Primary Examiner*—José V. Chen
*Attorney, Agent, or Firm*—Robert W. Becker & Associates

[57] ABSTRACT

A mechanism for adjusting the tilt and/or height of a countertop or table top of a piece of furniture. The mechanism includes a lifting element that acts on the countertop or table top and is connected to a drive gear mechanism. The lifting mechanism is a curved toothed rack or element, with the drive gear mechanism including a gear that is in engagement with the toothed element. A guide is provided for guiding the toothed element.

32 Claims, 13 Drawing Sheets

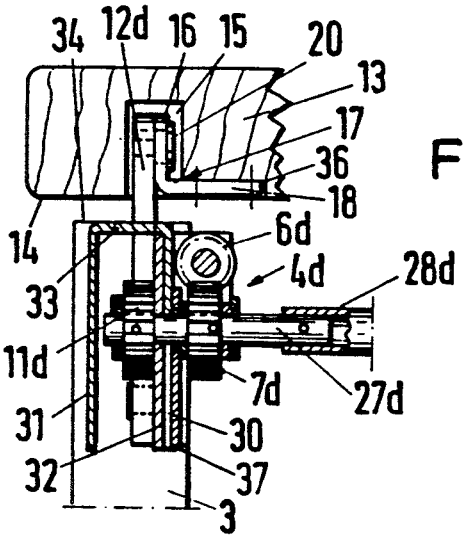
Fig.10
Fig.11
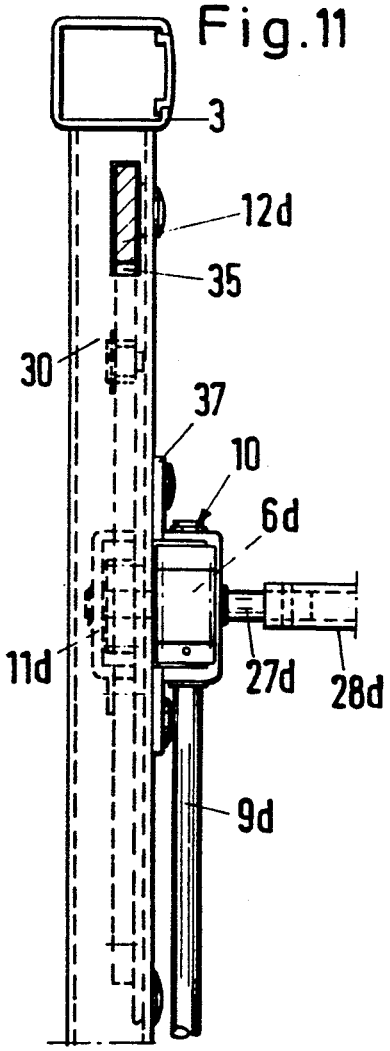
Fig.9
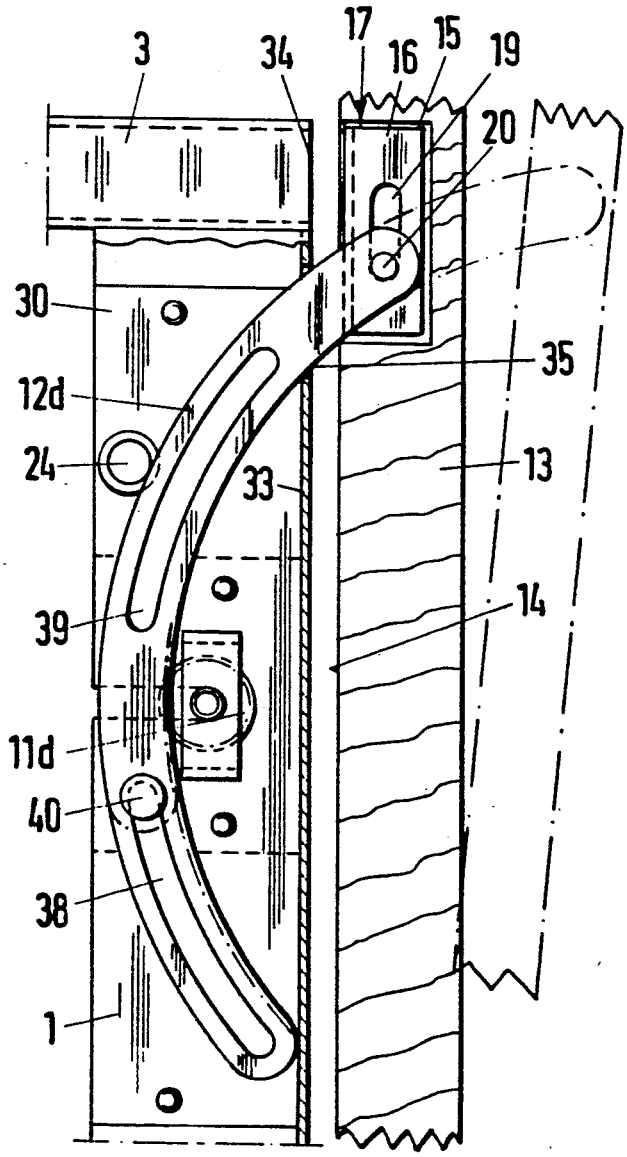

XII
XII

MECHANISM FOR ADJUSTING THE TILT AND/OR HEIGHT OF A COUNTERTOP OR TABLE TOP OF FURNITURE

BACKGROUND OF THE INVENTION

The present invention relates to a mechanism for adjusting the tilt and/or height of a countertop or table top of a piece of furniture, including at least one lifting element, which acts on the countertop or table top and is connected to a drive gear mechanism.

With such known adjustment mechanisms, the tilt and/or height of the countertop or table top of a piece of furniture can be adjusted. The lifting element is embodied as a lifting scissors with which the countertop or table top can be raised and lowered. If the countertop or table top is in its lower position, the lifting scissors then assumes its lowermost position, in which its legs form a large obtuse angle with one another. To raise the top, it is therefore necessary to exert a great amount of energy, because due to the fact that the legs of the lifting scissors are disposed at an obtuse angle relative to one another, an unfavorable distribution of force occurs. In addition, already with small adjustment paths of the lifting scissors a relatively great lifting stroke of the countertop or table top occurs. As the adjustment process continues, the force relationships become more favorable, so that the lifting scissors can be actuated with less force. Of course, there then also occurs only a small lifting stroke. Thus, this known adjustment mechanism has a nonuniform force-stroke-ratio. The lifting scissors is in addition sensitive to transverse stresses, because as a result thereof the hingedly interconnected legs of the lifting scissors can easily be bent. In certain cases, the lifting scissors can then no longer be actuated. Furthermore, the lifting scissors require a considerable amount of space for their installation.

The object of the present invention is to embody an adjustment mechanism of the aforementioned general type in such a way that while being easy to handle and requiring only little space for installation, it has a nearly constant force-stroke-ratio.

SUMMARY OF THE INVENTION

The adjusting mechanism of the present invention is characterized primarily in that the lifting element is a curved toothed rack or element, the drive gear mechanism includes gear means that is in engagement with the toothed element, and guide means are provided for guiding the toothed element.

With the curved toothed rack or element it is possible to provide a nearly constant force-stroke-ratio over the entire displacement path of the adjustment mechanism. Therefore, the force needed to raise the countertop or table top is nearly the same in every position thereof The lifting path per displacement path of the toothed element is nearly constant, so that the countertop or table top can be effortlessly and precisely adjusted to the desired position. The toothed element is satisfactorily guided on the guide means, so that the adjustment can be simply undertaken. Since the toothed element can have a flat construction, it can be mounted close to a side wall of the furniture so that it requires only little space. The toothed element is a sturdy component that has a long service life. The toothed rack or element drive gear mechanism additionally assures a smooth operation and precise adjustment of the countertop and table top.

Further features of the invention can be derived from the other claims, the specification, and the drawings.

BRIEF DESCRIPTION OF THE DRAWINGS

The invention will be explained in detail with the aid of several specific embodiments illustrated in the drawings, which show.

DESCRIPTION OF PREFERRED EMBODIMENTS

Figure 2:
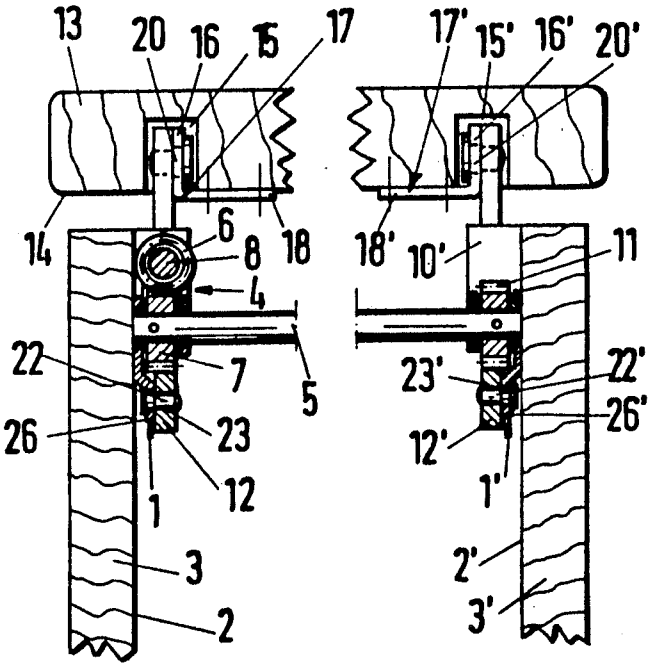
Figure 1:
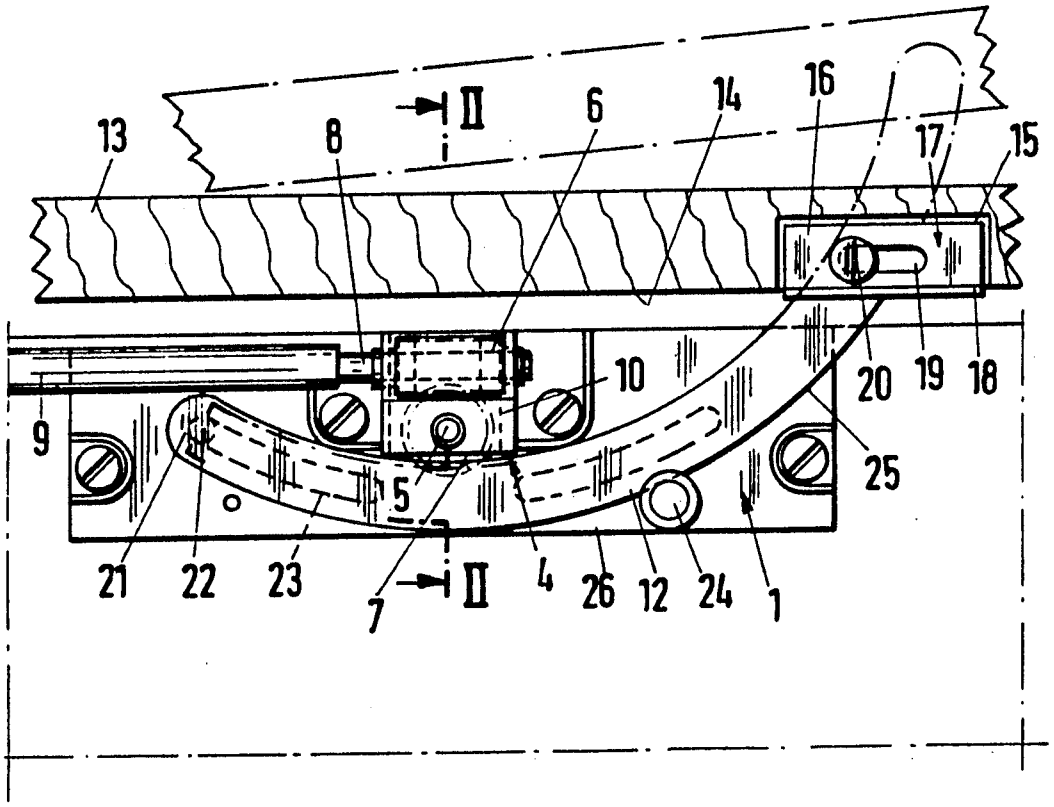
FIG. 1 a side view of a first exemplary embodiment of an inventive adjusting mechanism, FIG. 2 a cross-sectional view taken along the line II—II in FIG. 1, FIG. 3 a side view of a second exemplary embodiment of an inventive adjusting mechanism, FIG. 4 a cross-sectional view along the line IV—IV in FIG. 3, FIG. 5 a side view of a third exemplary embodiment of an inventive adjusting mechanism, FIG. 6 a cross-sectional view along the line VI—VI in FIG. 5, FIG. 7 a side view of a fourth exemplary embodiment of an inventive adjusting mechanism, FIG. 8 a cross-sectional view along the line VIII—VIII in FIG. 7, FIG. 9 a side view of a fifth exemplary embodiment of an inventive adjusting mechanism, FIG. 10 a cross-sectional view through the adjusting mechanism of FIG. 9, FIG. 11 a plan view of the adjusting mechanism of FIG. 9, FIG. 12 a view taken along the line XII—XII in FIG. 14 of a sixth exemplary embodiment of an inventive adjusting mechanism, FIG. 13 a bottom view of the adjusting mechanism of FIG. 12, FIG. 14 a cross-sectional view through the adjusting mechanism of FIG. 12, FIG. 15 the adjusting mechanism of FIG. 12 with the countertop of a piece of furniture tilted, FIG. 16 the adjusting mechanism of FIG. 12 with the countertop of the piece of furniture being adjusted in height, FIG. 17 another embodiment of a lifting element of the inventive adjusting mechanism, FIG. 18 a bottom view of a portion of a further exemplary embodiment of an inventive adjusting mechanism, FIG. 19 a side view of the adjusting mechanism of FIG. 18, FIG. 20 a cross-sectional view through the adjusting mechanism of FIG. 18, FIGS. 21 to 23 views similar to those of FIGS. 18 to 20 of a further exemplary embodiment of an inventive adjusting mechanism, FIGS. 24 to 26 views similar to FIGS. 18 to 20 of a further exemplary embodiment of an inventive adjusting mechanism, FIGS. 27 to 29 views similar to FIGS. 18 to 20 of a further exemplary embodiment of an inventive adjusting mechanism.

The fitting or mounting serves for adjusting the tilt and/or height of a countertop or table top of a piece of furniture, a table, or the like. The mounting of FIGS. 1 and 2 is provided with a mounting plate 1 that is secured to the inner side 2 of a side wall 3. In place of the side wall 3, it is also possible to provide a base or a frame part to which the mounting plate 1 is secured. Secured on the opposite side wall 3' (FIG. 2) is a further mounting plate 1' that is embodied in the same manner as is the mounting plate 1. Disposed on the mounting plate 1 is a gear mechanism 4 with which can be rotatably driven a shaft 5 that extends between the two mounting plates 1 and 1'. The gear mechanism 4 is provided with a spiral or worm gear 6, the helical gearing of which meshes with the gearing of a further spiral gear 7 that is fixedly seated on the shaft 5. The worm gear 6 is seated on a drive shaft 8 that extends parallel along the mounting plate 1 and is connected to a coupling rod 9 that leads toward the front to the seat side of the respective piece of furniture or table. In the (not illustrated) other end of the coupling rod 9 it is possible to insert a crank or handle with which the worm gear 6, and hence the shaft 5 via the gear mechanism 4, can be rotated. This handle can also be securely connected to the coupling rod 9. The gear mechanism 4 is accommodated in a gear housing 10 that is secured to the mounting plate 1. The spiral gear 7 extends slightly out of the bottom of the gear housing 10.

Rigidly seated on the other end of the shaft 5 in an axially secured manner is a gear wheel 11 that is also accommodated in a gear housing 10' out of the bottom of which it extends (FIG. 2).

Each of the gears 7 and 11 meshes with a respective toothed rack 12, 12' that is curved in the shape of a partial circle and extends below the gears and along the mounting plates 1 and 1'. One end of the racks 12, 12' is connected with the countertop or table top 13. The underside 14 of the countertop 13 is provided with recesses 15, 15' into each of which extends a respective leg 16 and 16' of an angle bracket 17, 17'. The horizontal legs 18, 18' of the angle brackets are secured to the underside 14 of the countertop or table top 13. The vertical legs 16, 16' that extend into the recesses 15, 15' are each provided with a slot 19 that extends in the longitudinal direction of the leg and through which extends a guide pin 20, 20' that is secured to the free end of the racks 12, 12'. The slot 19 assures that the relative movements that occur between the top 13 and the racks 12, 12' when the top is swung up or raised can take place.

The opposite end 21 of the racks 12, 12' is provided with a further guide pin 22, 22' that, just like the guide pins 20, 20', are securely connected to the rack and engage in a slot 23, 23' of the mounting plates 1, 1'. The slots 23, 23' have the same curvature as do the racks 12, 12', and limit the displacement path of the racks. In FIG. 1, the rack 12 is illustrated by solid lines in its one end position in which the top 13 assumes its lowermost position. In this position, the guide pins 22, 22' rest against one end of the slots 23, 23'.

To adjust the tilt and/or height of the top 13, the gear mechanism 4 is actuated via the coupling rod 9. Since the gears 7, 11 are in engagement with the racks 12, 12', these racks are shifted, with reference to FIG. 1, toward the right in their longitudinal direction. In this connection, the racks 12, 12' are each supported by a support roller 24 that in the region between the gear mechanism 4 and the angle brackets 17, 17' rests against that side 25 of the rack 12, 12' that is remote from the top 13. As a result, the racks 12, 12' are satisfactorily supported during displacement. Since the racks 12, 12' engage via the guide pins 22, 22' in the slots 23, 23', the racks are additionally also satisfactorily guided via these guide pins during displacement. In this connection, the diameter of the guide pins 22, 22' corresponds to the width of the slots 23, 23'. The length of the slots 23, 23' delimits the maximum displacement path of the racks 12, 12'. FIG. 1 illustrates with dot-dash lines that end position of the rack 12 in which the guide pins 22, 22' rest against that end of the slots 23, 23' that faces the guide pins 20, 20' and in which the top 13 has its greatest tilted position.

Since the two gears 7 and 11 are drivingly interconnected via the shaft 5, when the gear mechanism 4 is actuated both racks 12, 12' are simultaneously driven, so that the top 13 is uniformly tilted over its length or width.

With the described mounting it is also possible to adjust not only the tilt but also the height of the top 13. For this purpose, further mountings having the described adjustment mechanism are provided at the opposite end of the top, so that the height of this side of the top 13 could also be adjusted. In this case, it is expedient to dispose the adjustment mechanisms in pairs, so that the height and the tilt of the top 13 can be continuously adjusted.

The gear mechanisms are accommodated in a protected manner in the gear housings 10, 10'. Since the mountings are disposed on facing inner sides 2, 2' of the side walls 3, 3' of the respective furniture, they are not visible from the outside. The only thing visible from the outside is that portion of the racks 12, 12' that is disposed between the underside 14 of the top and the side walls 3, 3', and this is not disturbing. The mountings with the adjustment mechanisms are extremely thin and flat, so that they can also be used under tight installation conditions. The oppositely disposed spiral gears 6, 7 of the gear mechanism 4 require little space. The entire adjustment mechanism can be easily mounted on the side walls 3, 3' with the mounting plate 1 or 1'. The shaft 5 is disposed only slightly from the upper rim of the side walls 3, 3', so that it is not disruptive An electric motor can also be connected to the coupling rod 9, so that adjustment of the height and/or tilt of the top 13 can also be undertaken with a motor. With the described adjustment mechanism, a nearly uniform force/lifting ratio can be achieved over the displacement path of the racks 12, 12', i.e. a nearly uniform lifting stroke is achieved over the entire displacement path of the racks 12, 12' with a nearly uniform force or effort. As a result, the top 13 can be raised and lowered by the operator in a controlled manner over the entire displacement path.

Figure 4:
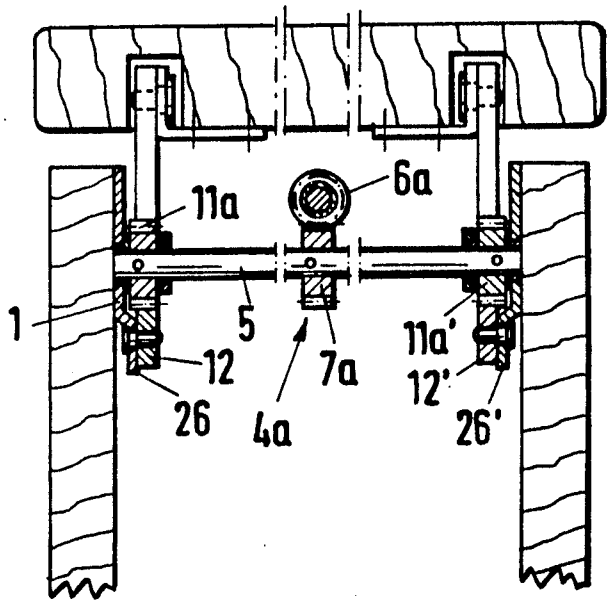
Figure 3:
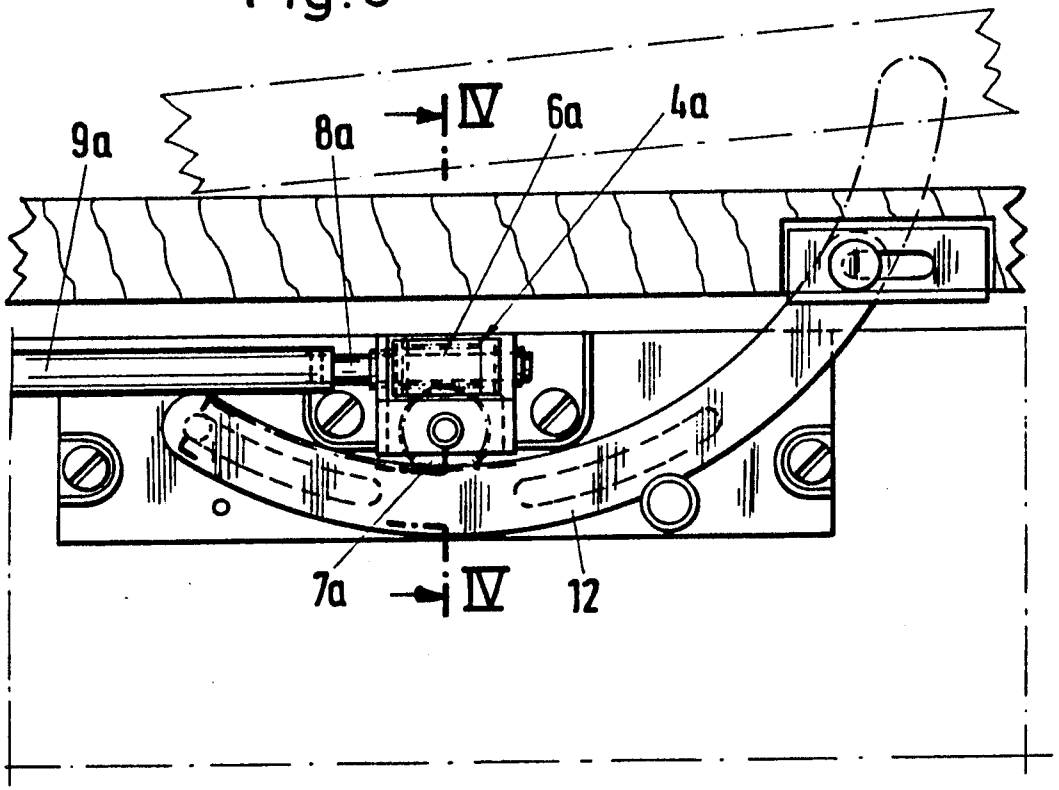

The embodiment illustrated in FIGS. 3 and 4 differs from the previously described embodiment essentially merely in that the gear mechanism 4*a*, rather than being disposed on the mounting bracket 1, is disposed approximately halfway along the length of the shaft 5. Its spiral gears 6*a* and 7*a* are disposed in the same manner as with the previously described embodiment. The spiral gear 7*a* is fixedly seated on the shaft 5, the two ends of which each rigidly support a gear wheel 11*a*, 11*a*'. These gear wheels 11*a*, 11*a*' are seated in an axially secured manner on the shaft 5 and engage the racks 12, 12' in the described manner. The worm gear 6*a* is again fixedly seated on the drive shaft 8*a* that is connected to the coupling rod 9*a*. A handle or an electric motor can be connected to the coupling rod in the manner described. By actuating the gear mechanism 4*a*, the shaft 5 is rotated, whereby via the gear wheels 11*a*, 11*a*' the racks 12, 12' are shifted in the described manner. The adjustment mechanism of FIGS. 3 and 4 is in other respects embodied in the same manner as is the embodiment of FIGS. 1 and 2.

The embodiment of FIGS. 3 and 4 can be used where there is no space to install the coupling rod 9*a* on the side walls. In this case, the gear mechanisms 4*a* is disposed in the region between the two adjustment mechanisms, in the illustrated embodiment halfway along the shaft 5.

Figure 6:
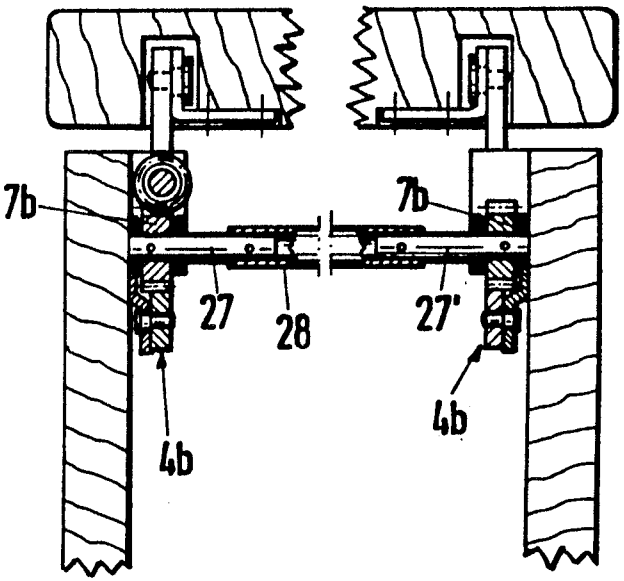
Figure 5:
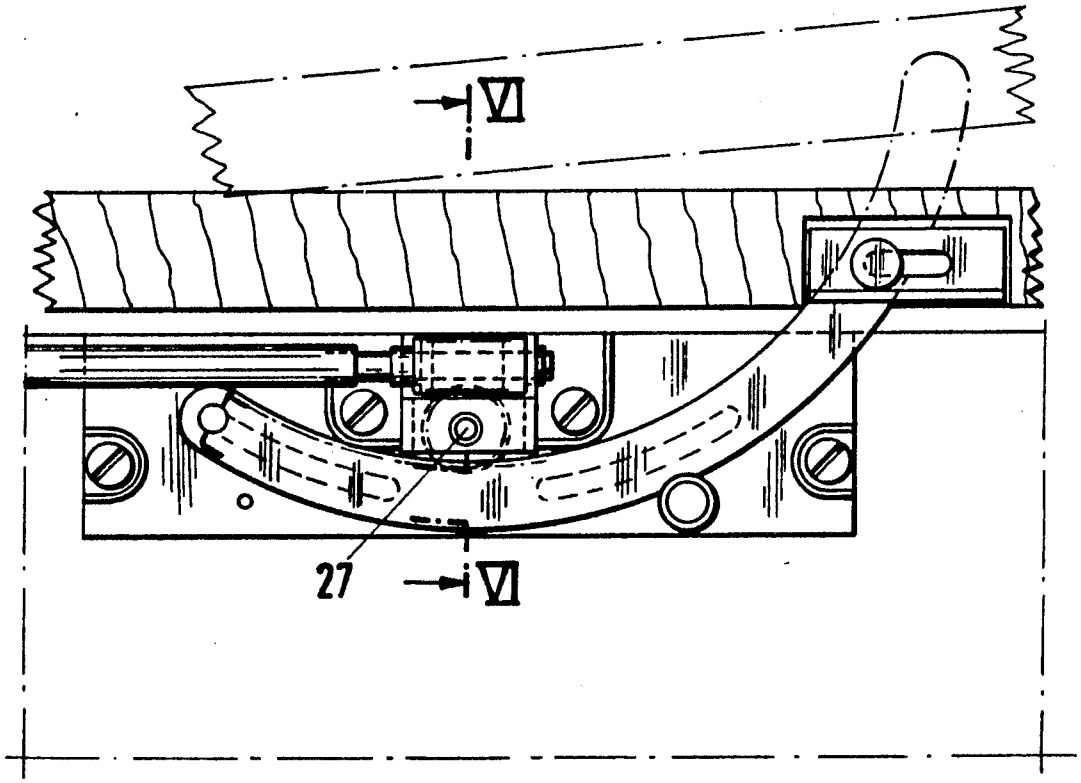

The embodiment illustrated in FIGS. 5 and 6 essentially corresponds to the embodiment of FIGS. 1 and 2. Instead of the continuous shaft 5, the gear mechanisms 4*b* are each provided with a shaft stub 27, 27'; these shaft studs are fixedly connected with the spiral gears 7*b*. The shaft stubs 27, 27' of the oppositely disposed gear mechanisms 4*b* are rigidly interconnected by a tube 28, so that the shaft stubs and this tube form the shaft of the mounting. This embodiment has the advantage that the tube 28 can be cut to the required installation length on site. As a result, it is possible in a straightforward manner to take into account installation tolerances.

Figure 8:
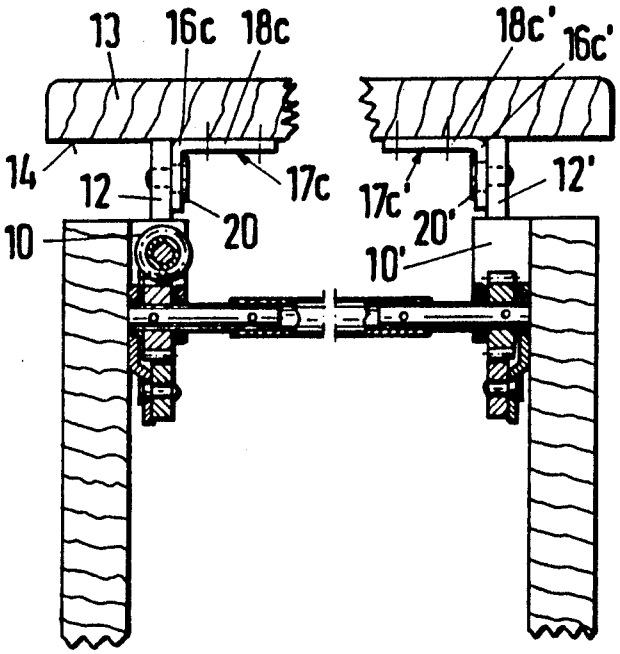
Figure 7:
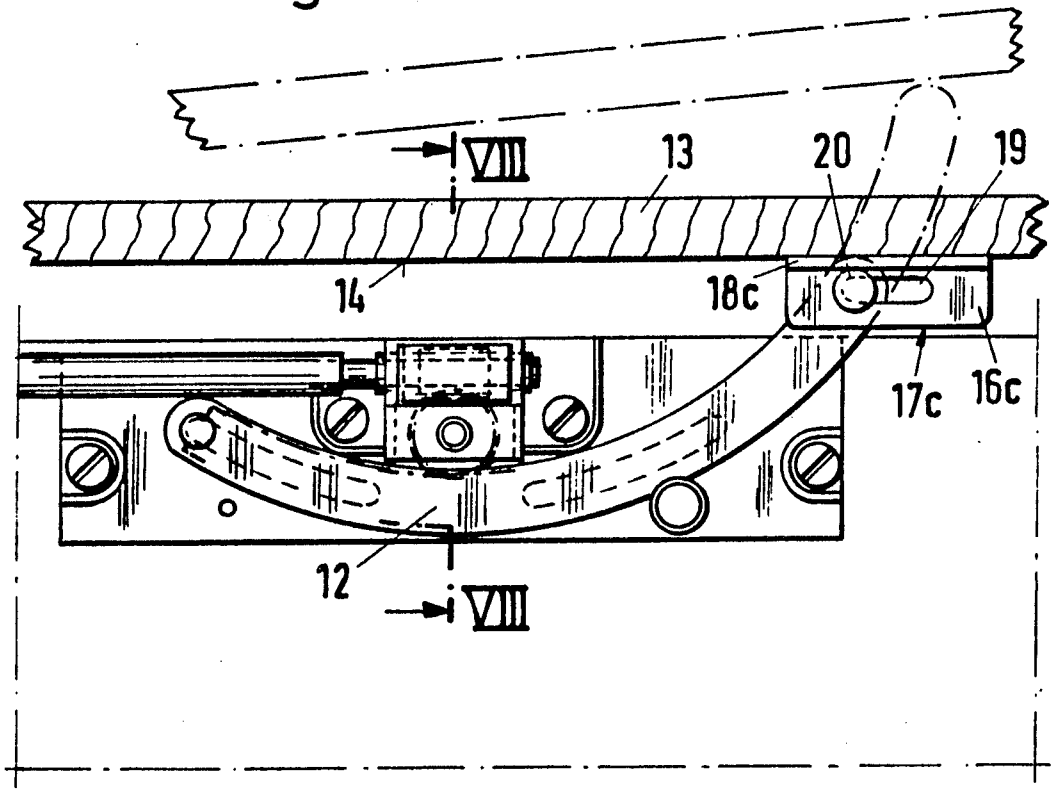

The embodiment illustrated in FIGS. 7 and 8 essentially corresponds to the embodiment of FIGS. 5 and 6. The only difference is that the horizontal legs 18*c*, 18*c*' of the angle brackets 17*c*, 17*c*' are secured to the underside 14 of the top 13. The vertical legs 16*c*, 16*c*' of the angle brackets 17*c*, 17*c*' are connected with the rack 12, 12' via the guide pins 20, 20'. The vertical leg 16*c*, 16*c*' is provided with the longitudinal slot 19 for the guide pins 20, 20'. The vertical legs 16*c*, 16*c*' extend downwardly in a direction toward the gearing housing 10, 10'. Since in contrast to the previous embodiments no recess has to be provided in the underside of the top for the angle brackets 17*c*, 17*c*', the top itself merely has to be finished and mounted.

In the embodiment illustrated in FIGS. 9 to 11, the greatest portion of the length of the rack 12*d* is covered in a U-shaped cross member 30 that extends between two bases or legs 3 of the piece of furniture. Only one leg 3 is illustrated in FIGS. 9 to 11. The two opposite sides of the countertop 13 are each provided with two legs. The sides 31, 32 of the cross member 30 extend downwardly, whereas the crosspiece 33 is flush with the end face 34 of the legs 3 (FIGS. 9 and 10). The rack 12*d* extends through an opening 35 in the crosspiece 33. As shown in FIG. 9, by far the greatest portion of the rack 12 is covered or concealed between the two sides 31, 32 of the cross member 30.

The countertop 13 is provided on its underside 14 with the recesses 15 into which the vertical leg 16 of the angle bracket 17 extends. In contrast to the previous embodiments, the horizontal leg 18 of the angle bracket 17 (FIG. 10) is disposed in a recessed portion 36 that adjoins the recess 15, so that the horizontal leg does not project downwardly beyond the underside 14 of the countertop 13. In this way, the gap between the countertop 13 and the end face 34 of the legs 3 and the crosspiece 33 of the cross member 30 can be kept to a minimum in the lowermost position of the countertop.

The vertical leg 16 of the angle bracket is again provided with the longitudinal slot 19 in which is disposed the guide pin 20, which is securely connected to the rack 12.

Seated on that outer side of the side 32 of the cross member 30 that is remote from the side 31 is the gear mechanism 4*d* with the spiral gears 6*d*, 7*d*. The worm gear 6*d* is again rigidly connected to the coupling rod 9*d*, which extends along the side 32 toward the front to the seat side of the respective furniture or table. Rigidly connected to the other spiral gear 7*d* is the shaft stub 27*d*, which is drivingly connected via the tube 28*d* with the shaft stub of the oppositely disposed gear mechanism. The gear housing 10 is detachably secured to the side 32 of the cross member 30 via a mounting plate 37.

The shaft stub 27*d* extends through the side 32 of the cross member 30 (FIG. 10). Seated on the shaft stub end that is disposed between the two sides 31, 32 is the gear wheel 11*d*, which meshes with the rack 12*d*. The gear wheel 11*d* is securely seated on the shaft stub and is axially secured. A gear wheel that meshes with the oppositely disposed rack is similarly accommodated on the opposite side in the cross member.

In contrast to the previous embodiments, the rack 12*d* is provided with two spaced-apart slots 38 and 39 that are curved in the shape of a partial circle. A guide pin 40 that is secured to the mounting plate 1 extends through the slot 38. In addition, the rack 12*d* is supported and guided by the support roller 24.

By rotating the coupling rod 9*d*, the shaft stubs 27*d*, along with the tube 28*d* that is rigidly connected thereto, are rotated via the gear mechanism 4*d*. Via the gear wheels 11*d*, the racks 12*d* are displaced, thereby raising or lowering the countertop 13. The rack 12*d* is disposed in a protected manner in the cross member 30. The countertop 13 can extend to nearly the crosspiece 33 of the cross member 30, so that the gap between the countertop and the cross member is small. For all practical purposes, the rack 12*d* is therefore not visible from the outside.

It is to be understood that the rack, in place of the slot 38, could also, as with the previous embodiments, be provided with the guide pin that engages an appropriate slot in the mounting plate. Conversely, with the previously described embodiments it is possible to provide the guide pins 22, 22' in the mounting plate, with the racks being provided with the guide slots for these guide pins.

In the embodiment illustrated in FIGS. 12 to 16, the adjusting mechanism, which is embodied as a mounting, is provided with an L-shaped mounting plate 101, a horizontal leg 102 of which rests upon a leg, support, frame part 103, and the like. The vertical leg 104 is disposed parallel to the inner side 105 of the frame part 103. Close to its lower edge 106, the vertical leg 104 is provided with a slot 107 (FIG. 12) that extends in the longitudinal direction of the leg and that is provided at the rear end of the leg 104, as seen from the standpoint of a user that is sitting in front of the furniture. A guide element 108, which is preferably embodied as a pin and is secured to one end of the rack 109, is guided in the slot 107. As with the previous embodiments, the rack is curved in the shape of a partial circle over an angle of less than 180°. At the other end, which faces a user that is sitting in front of the furniture, the rack 109 is provided with a further guide element 110, which is preferably embodied as a pin and engages in a slot 111 of an intermediate plate 112. The slot 111 is curved in conformity to the rack 109, and extends over only a portion of the length of the rack 109.

Figures 12, 13, 14:
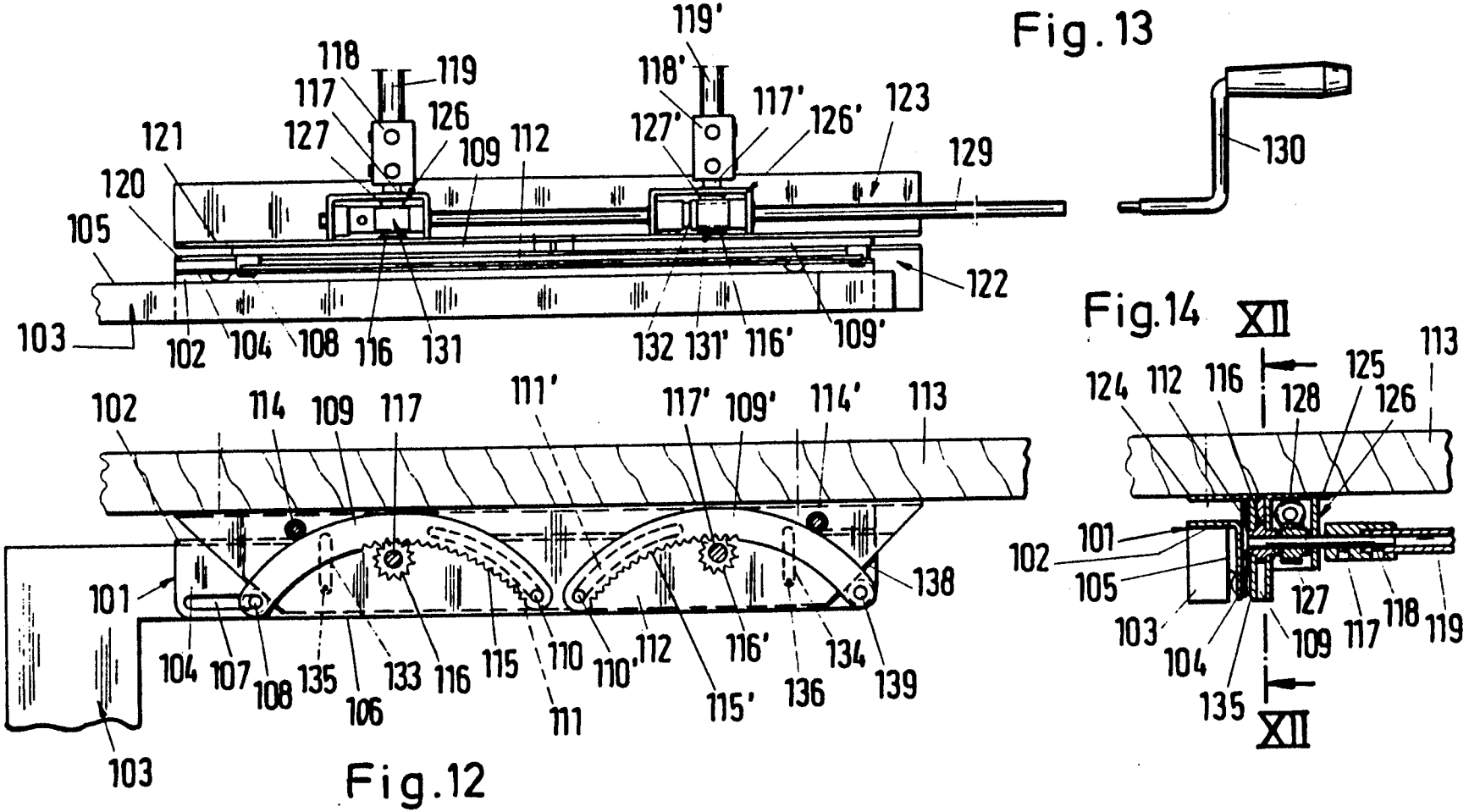

Provided immediately adjacent to the rack 109 is a second rack 109', which is similarly curved in the shape of a partial circle and extends over an arc of less than 180°. The rack 109' is provided with a guide element 110 that is preferably in the form of a pin, is disposed immediately adjacent to the guide element 110, and engages in a curved slot 111' in the intermediate plate 112. The slot 111' has the same curvature as does the rack 109', and extends over less than half the length of the arc of the rack. At the other end, the rack 109' is hinged to the vertical leg 104 of the mounting plate 101. As shown in FIG. 12, the racks 109, 109' are disposed in a mirror symmetrical manner relative to one another. In addition, they extend over the same angular range and are each curved convexly relative to the countertop or table top 113 of the piece of furniture.

On their convex sides that face the countertop 113, each rack 109, 109' is supported by at least one support roller 114, 114'. On the opposite side, the racks 109, 109' are provided with teeth 115, 115' that extend from that end of the rack that is provided with the guide element 110, 110' and preferably extend over more than half of the arc length of the rack. Engaging these teeth is a gear wheel 116, 116' that is securely seated on a shaft part 117, 117'. This shaft part is securely connected via a connector 118, 118' with a connecting shaft 119, 119', which extends to the oppositely disposed frame part 103.

The two racks 109, 109' are disposed between two vertical legs 120, 121 of two L-shaped rails 122, 123, the horizontal legs 124, 125 (FIG. 14) of which are secured to the underside of the countertop 113. The two racks 109, 109' are satisfactorily guided between the vertical legs 120, 121 of the rails 122, 123.

The two gear wheels 116, 116' are rotatably mounted in openings in the vertical legs 120, 121. Secured on that side of the leg 121 remote from the leg 120 are two gear housings 126, 126' in each of which is seated a spiral gear 127, 127' that is securely disposed on the shaft part 117, 117'. These spiral gears mesh with respective worm gears 128, 128' that are accommodated in the gear housings 126, 126,, with only the worm gear 128 being illustrated in FIG. 14 Both of the worm gears 128, 128' are seated on an actuating shaft 129 that extends parallel to the vertical leg 121 of the rail 123 (FIG. 13) and extends to the seat side of the furniture. A crank or handle 130 can be inserted in the actuation shaft 129. The worm gears 128, 128' and the actuation shaft 129 are disposed in a region above the connecting shafts 119, 119'.

The gear mechanisms 131, 131', which are accommodated in the gear housings 126, 126', can be actuated together via the actuation shaft 129. Provided in the gear housing 126' is a coupling 132 via which the gear mechanism 131' can be disengaged in such a way that it is not effective when the actuation shaft 129 is rotated. To actuate the coupling 132, the actuation shaft 129 is shifted axially, as will be described in detail subsequently.

The two connecting shafts 119, 119', which are disposed perpendicular to the actuation shaft 129, connect the gear mechanisms 131, 131' with the gear mechanisms that are provided on the opposite part of the frame and which are embodied in the same manner.

The intermediate plate 112 is disposed between the vertical leg 104 of the mounting plate 101 and the vertical leg 120 of the rail 122. The intermediate plate 112 is provided with two slots 133, 134 (FIG. 12) that extend parallel to one another as well as in the vertical direction of the intermediate plate, and into which extends a respective guide element 135, 136 that is secured to the vertical leg 120 of the rail 122 and projects at right angles therefrom.

Figure 15:
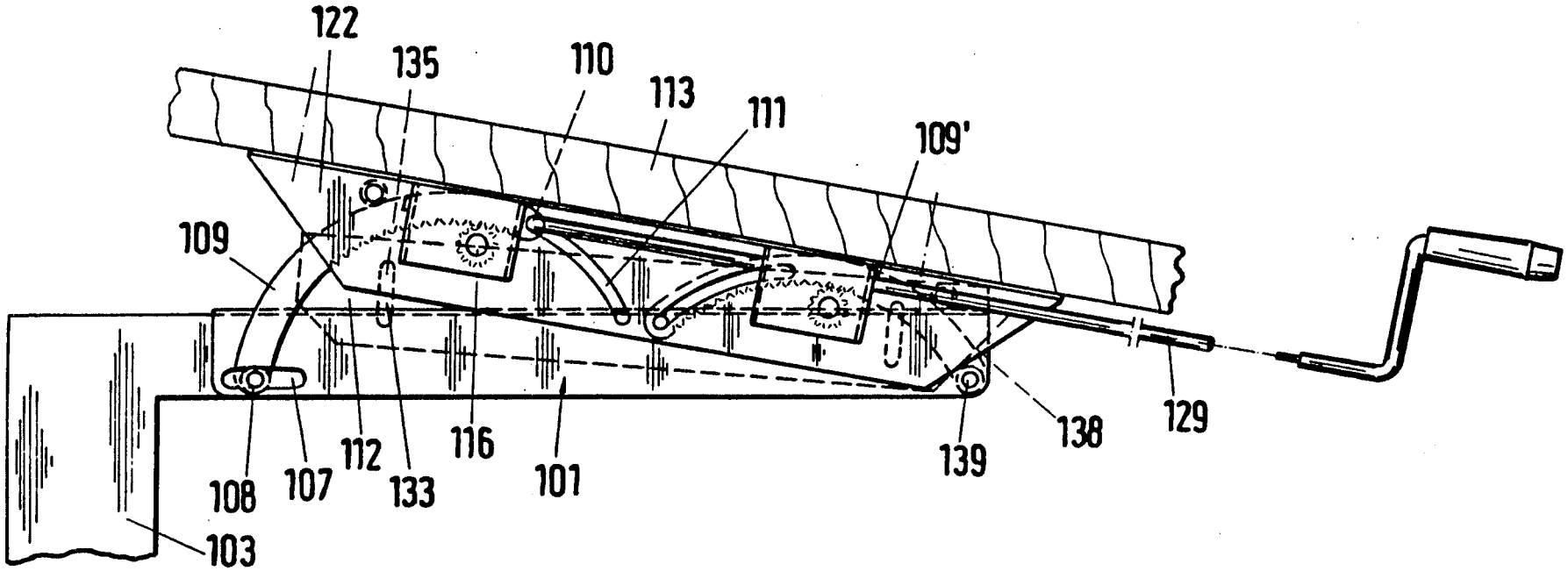
Figure 16:
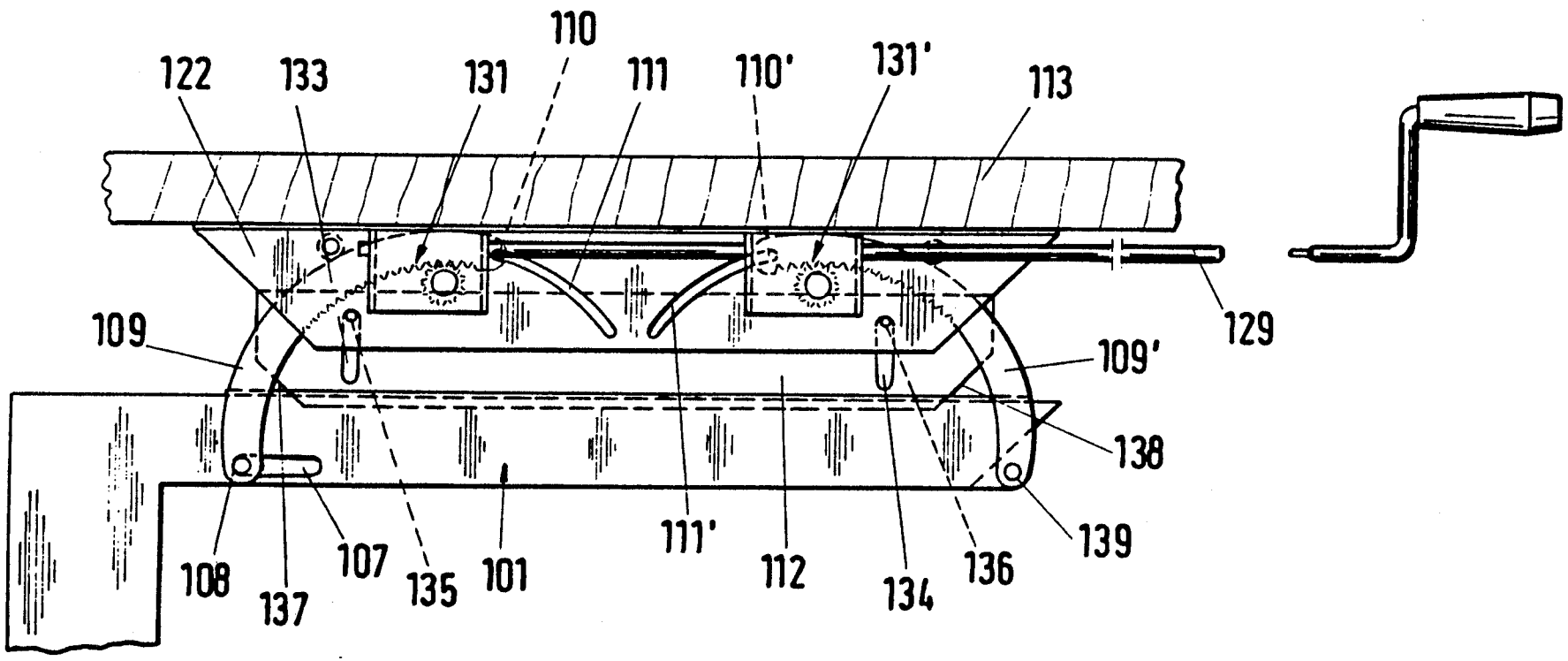

In the lowered horizontal position of the countertop 113 illustrated in FIG. 12, the guide element 108 of the rack 109 rests against that end of the slot 107 that faces the rack 109'. The other guide element 110 of the rack 109 rests against that end of the curved slot 111 that faces the rack 109'. The guide element 110' rests against that end of the slot 111' that faces the rack 109. The intermediate plate 112 is lowered to such an extent that its sloped edges 137, 138 rest against the guide element 108 of the rack 109 and on the pivot shaft 139 of the rack 109'. In this connection, the guide elements 135, 136 of the rail 122 rest against the lower end of the slots 133, 134 of the intermediate plate 112. The intermediate plate 112 is concealed behind the vertical leg 120 of the rail 122. The gear wheels 116, 116' engage those ends of the teeth 115, 115' of the racks 109, 109' that are remote from one another. To adjust the tilt of the countertop 113 (FIG. 15), the actuation shaft 129 is shifted axially to the rear from the seat side of the furniture. In so doing, the gear mechanism 131' is disengaged via the coupling 132. If the actuation shaft 129 is now turned with the handle 130, the gear wheel 116 is rotated via the gear mechanism 131. As a result, the rack 109 is shifted relative to the rail 122 along a circular arc. Since the rack 109 is guided by the guide element 108 in the slot 107 of the mounting plate 101 the countertop 113 is raised at that end that is remote from the seat side by the displacement of the rack 109. In so doing, the guide element 135 of the rail 122 is shifted in the slot 133 of the intermediate plate 112 until it abuts the other end of the slot and then takes the intermediate plate 112 with it (FIG. 15). At the opposite end, the intermediate plate 112 is pivotably supported upon the link element 139 of the rack 109 via its sloped edge 138. At the same time, the rack 109' pivots about the link element 139, although in so doing it is not shifted relative to the rail 122. The guide element 110 is shifted in the slot 111 of the rail 122. The countertop 113 has its greatest tilt when the guide element 110 abuts against that end of the slot 111 that is remote from the rack 109'. As a result of the engagement of the gear wheel 116 in the rack 109, the countertop 113 is held in every tilt position, being supported on the frame part 103 via the rack 109, its guide element 108, and the mounting plate 101. In addition, the countertop 113 is also supported on the frame part 103 via the link element 139 and the mounting plate 101. The gear mechanisms 131, 131' of the one frame part 103 are drivingly connected with corresponding gear mechanisms on the opposite frame part via the connecting shafts 119, 119', so that the countertop 113 can be uniformly raised or tilted on both sides.

If the rack 109' that faces the seat side of the furniture is also to be adjusted, the actuation shaft 129 must first be axially retracted, so that the coupling 132 of the gear mechanism 131' is engaged. Both gear mechanisms 131, 131' are then simultaneously actuated by the actuation shaft 129. The two racks 109, 109' are then synchronously shifted out of the starting position of FIG. 12 in approximately opposite directions, with the guide element 110 of the rack 109 being shifted in the slot 111 of the rail 122 and the guide element 108 being shifted in the slot 107 of the mounting plate 101. The guide element 110' of the other rack 109 is similarly shifted in the slot 111' of the rail 122. In addition, the rack 109' pivots relative to the mounting plate 101 via its link or hinge element 139. In view of the oppositely directed movements of the racks 109, 109', the countertop 113 is uniformly raised. Via the guide elements 135, 136 of the rail 122, the intermediate plate 112 is also raised as soon as the guide elements abut the upper ends of the slots 133, 134 of the intermediate plate. The uppermost end position of the countertop 113 is reached when the guide elements 110, 110' of the racks 109, 109' abut those ends of the slots 111, 111' that are remote from one another.

During resetting of the countertop 113, the intermediate plate 112, which is suspended upon the guide elements 135, 136, is lowered until its sloped edges 137, 138 rest against the guide element 108 and the hinge element 139. The movement sequences are coordinated with one another in such a way that the intermediate plate 112 does not come to rest until the guide element 108 is nearly in its end position illustrated in FIG. 12. By utilizing the loosely suspended intermediate plate 112, a large adjustment path is achieved without the rail 122 having to be particularly high. In the lowered position of the countertop 113 (FIG. 12), the vertical leg 120 of the angle rail 122 therefore does not extend downwardly beyond the horizontal portion of the frame part 103. When viewed in the axial direction of the connecting shafts 119, 119', the intermediate plate 112 is also concealed behind the vertical leg 120. Also with this embodiment, the countertop 113 can be lowered to such an extent that it is spaced only slightly from the frame part 103. As a result, the adjustment mechanism is only slightly visible from the outside.

Figure 17:
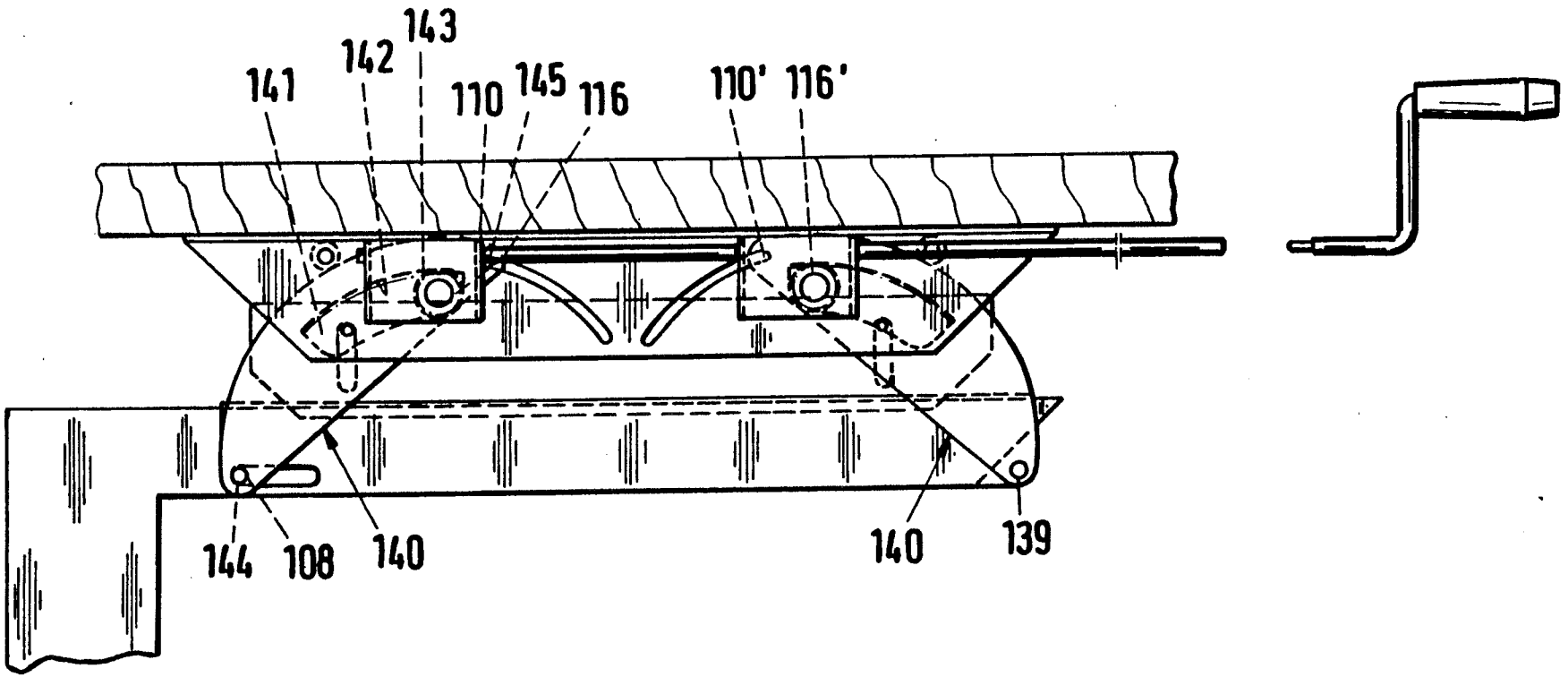

Instead of the racks 109, 109', it is also possible to use as a lifting element a respective toothed part 140, such as is illustrated in FIG. 17. This part has a cutout portion 141, the one edge 142 of which that is curved in the shape of an arc being provided with the teeth 143. The gear wheel 116, 116' that engages these teeth extends partially through the cutout portion 141. The length of the cutout portion 141 corresponds approximately to the length of the teeth 143. The toothed part 140 is further provided with a receiving opening 144 for the guide element 108 for the link part 139, as well as a receiving opening 145 for the guide elements 110 or 110'. The toothed part has a high stability and can be easily manufactured.

The adjusting mechanism illustrated in FIGS. 18 to 20 is again provided with a mounting plate 201 that is secured to the inner side of a side wall 202. Secured on the oppositely disposed (not illustrated) side wall is a further mounting plate that has the same construction as does the mounting plate 201. To adjust the tilt and/or height of the countertop or table top 203, two toothed parts 204, 204' are provided that are aligned with one another and are spaced slightly apart. The mounting plate 201 is L-shaped and has a horizontal leg 205 with which it rests upon the side wall 202 of the leg, support, frame part, or the like. The vertical leg 206 is disposed parallel to the inner side 207 of the frame part 202. Near its lower edge 208, the vertical leg 206 is provided with a slot 209 that extends in the longitudinal direction (FIG. 19) and that is disposed at the rear end of the leg 206, as seen from the viewpoint of a user seated in front of the furniture. Guided in the slot 209 is a guide element 210 that is preferably embodied as a pin and that is secured to one end of the toothed part 204. At the other end, which faces a user that is seated in front of the furniture, the toothed part 204 is provided with a further guide element 211 that is preferably embodied as a pin and that engages in a curved slot 212 of an intermediate plate 13.

Figures 18, 19, 20:
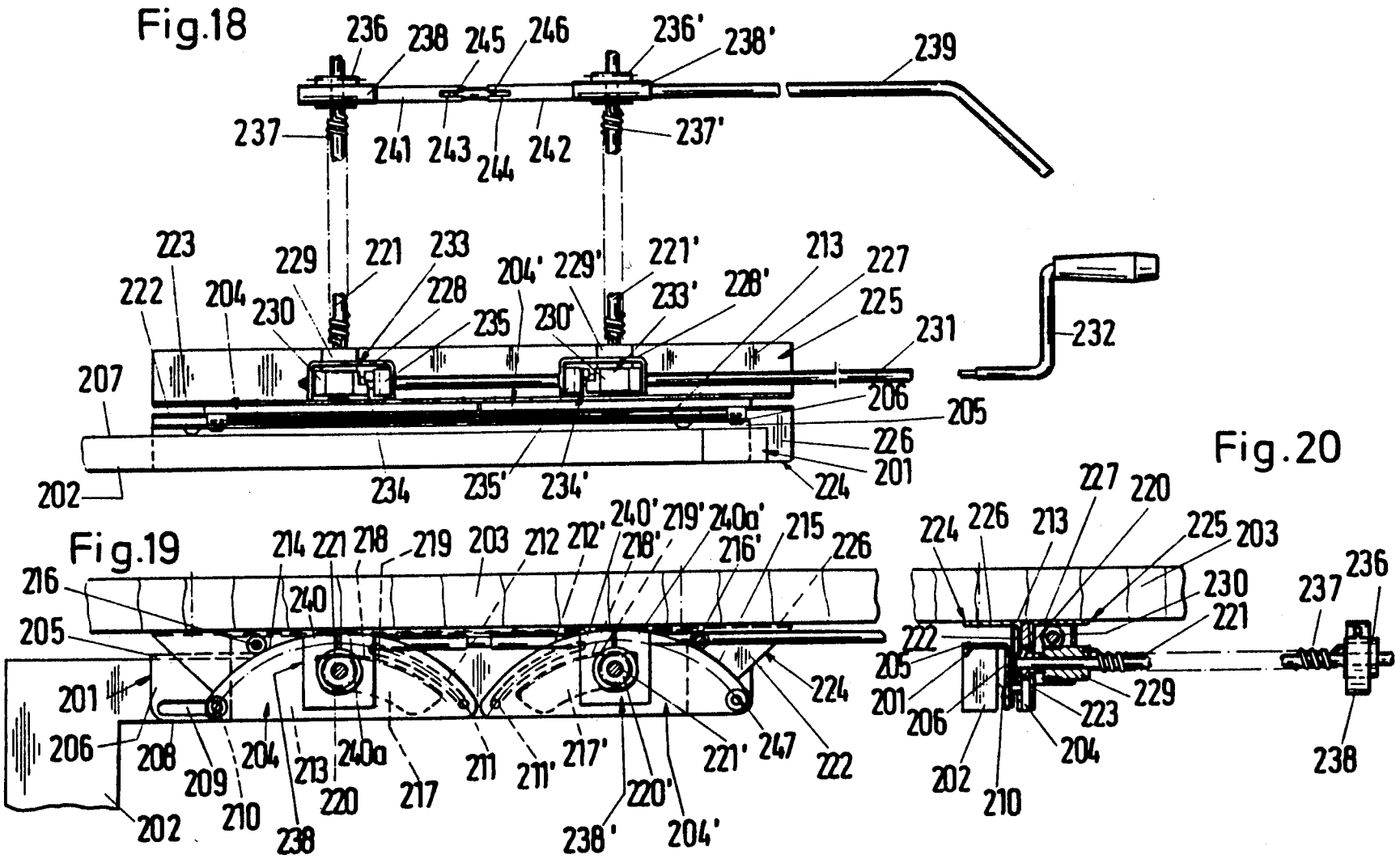

As shown in FIG. 19, the partially circular edge of the toothed parts 204, 204' that faces the top 203 extends over an angle of less than 180°. The slot 212 extends parallel to the curved edge 214 of the toothed part 204, yet extends over only a portion of the length of this edge.

The toothed part 204' also has a partially circular edge 215 that faces the top 203 and extends over an angular range of less than 180°. The toothed part 204' is provided with a guide element 211' that is preferably in the form of a pin, is disposed immediately adjacent to the toothed part 204, and extends into a curved slot 212' in the intermediate plate 213. The slot 212' has the same curvature as the edge 215 of the toothed part 204' and extends over less than half the arc length of this edge. At the other end, the toothed part 204' is hinged to the vertical leg 206 of the mounting plate 201.

The two toothed parts 204, 204' are disposed in a mirror symmetrical manner relative to one another. Their edges 214, 215 are each convexly curved relative to the top 203.

On their convex side that faces the plate 203, each toothed part 204, 204' is supported by at least one support roller 216, 216'.

he toothed parts 2024, 204' are each provided with a cutout portion 217, 217', each edge 218, 218' of which that faces the edge 214, 215 being provided with teeth 219, 219'. The edges 218, 218' extend parallel to the edges 214 and 215 of the toothed parts 204, 204'. The cutout portions 217, 217' are provided in the region of the adjacent ends of the toothed parts.

Extending into the teeth 219, 219' are respective gear wheels 220, 220' that are securely seated on a shaft 221, 221'. The shafts 221, 221' extend to the oppositely disposed (not illustrated) frame part.

The two toothed parts 204, 204' are disposed between two vertical legs 222, 223 of two L-shaped rails 224 and 225, the horizontal legs 226 and 227 of which are secured to the underside of the top 203. The two toothed parts 204, 204' are satisfactorily guided between the vertical legs 222, 223 of the rails 224, 225.

The gear wheels 220, 220' extend through the vertical legs 222, 223 of the rails 224, 225 (FIG. 20). Secured on that side of the vertical leg 223 remote from the leg 222 are two gear housings 228, 228' (FIG. 18) in which are seated worm gears 229, 229' that are respectively disposed on the shafts 221, 221'. As shown in FIGS. 18 and 20, the worm gears 229, 229' extend out of the gear housings 228, 228'. Within the gear housings, the worm gears 229 229' mesh with a respective spiral 230, 230'. Both spiral gears 230, 230' are seated on a common actuation shaft 231 that extends parallel to the vertical leg 223 of the rail 225 (FIG. 18) and extends to the seat side of the furniture. A crank or handle 232 can be inserted into the actuation shaft 231. The spiral gears 230, 230' and the actuation shaft 231 are disposed in the region above the connecting shafts 221, 221'.

With the actuation shaft 231, the gear mechanism 233, 233' that are accommodated in the gear housings 228, 228' can be actuated together. Provided in each of the gear housings 228, 228' is a respective coupling 234, 234' that is each provided with a coupling element 235, 235' that is fixedly seated on the actuation shaft 231. In the position illustrated in FIG. 18, the coupling elements 235, 235' are in engagement with the spiral gears 230, 230'. As a result, when the actuation shaft 231 is rotated, both of the spiral gears 230, 230' are rotatably driven.

The actuation shaft 231 can be axially displaced relative to the spiral gears 230, 230'. If the actuation shaft 231 is axially shifted to the left via the handle 232 when viewed from the position illustrated in FIG. 18, the coupling element 235' is disengaged from the spiral gear 230'. As a result, when the actuation shaft 231 is rotated, only the spiral gears 229, 230 are rotatably driven.

However, if the actuation shaft 231 is shifted to the right in FIG. 18, the coupling element 235 is disengaged from the spiral gear 230. If the actuation shaft 231 is then rotated, only the spiral gears 229', 230' are rotatably driven.

Fixedly seated at a distance from the gear housings 228, 228' on the connecting shafts 221, 221' are respective brake rings 236, 236' in which is attached one end of a coil spring 237, 237' that extends around the shaft 221, 221'. The other end of the coil spring 237, 237' is attached in the worm gears 229, 229'. The brake rings 236, 236' are surrounded by clamping or retaining rings 238, 238' that can be actuated by a common actuation shaft 239 (FIG. 18). The clamping rings 238, 238' have spaced apart ends 240, 240*a* and 240', 240*a*' (FIG. 19) that are provided with aligned bores in each of which is disposed a threaded section of the actuation shaft 239. The threads in the ends of the clamping rings extend in opposite directions, so that when the actuation shaft 239 is rotated, the two ends of each clamping ring 238, 238' are moved in opposite directions. That end of the actuation shaft 239 that faces the user of the furniture is preferably angled off, so that this end is disposed in the region of the handle 232 of the actuation shaft 231.

As shown in FIG. 18, the clamping rings 238, 238' are provided with coupling sleeves 241, 242 that are directed toward one another and through which the actuation shaft 239 extends. The actuation shaft can be shifted axially relative to the coupling sleeves 241, 242. The coupling sleeves 241. 242 are provided with axially extending slots 243, 244 through which extend guide pins 245 and 246 that project radially from the actuation shaft 239. These guide pins 245, 246 establish the fixed connection between the actuation shaft and the coupling sleeves 241, 242. In the position illustrated in FIG. 18, when the actuation shaft 239 is rotated, both coupling sleeves 241, 242 are rotatably taken along by the guide pins 245, 246. If the actuation shaft 239 in FIG. 18 is shifted to the left, the guide pin 246 becomes disengaged from the open edge slot 244 of the coupling sleeve 242, so that when the actuation shaft is rotated, only the coupling sleeve 241 is rotatably taken along. If the actuation shaft 239 in FIG. 18 is shifted to the right, the guide pin 245 is released from the open edge slot 243 of the coupling sleeve 241, so that if the actuation shaft 239 is now rotated, only the coupling sleeve 242 is rotatably taken along.

The clamping rings 238, 238' are normally in their clamping position, in which they tightly surround the brake rings 236, 236'. The two coil springs 237, 237' serve as weight-compensating devices with which the weight of the top 203 can be absorbed or compensated for during adjustment. Depending upon the weight of the top 203, the preload of the coil springs 237, 237' can simply be set by the gear mechanisms 233, 233'. For this purpose, it is merely necessary to rotate the actuation shaft 231 in the appropriate direction with the handle 232. If both couplings 234, 234' are in the coupling position, as in FIG. 18, then both spiral gears 230, 230' are rotated when the actuation 231 is rotated. As a result, the worm gears 229, 229' that mesh therewith and are rotatably seated on the shafts 221, 221' are rotated. Since one end of the coil springs 237, 237' is suspended in these worm gears 229, 229', the preload or tension of the coil springs is increased or reduced depending upon the direction of rotation. The brake rings 236, 236', in which the other end of the coil springs 237, 237' is suspended, cannot be rotated during this adjustment process, because they are held securely in position by the clamping rings 238, 238'.

If the height of the top 203 is to be adjusted, the clamping rings 238, 238' are then loosened by rotating the actuation shaft 239'. Adjustment of the height of the top 203 can now be undertaken. Since the brake rings 236, 236' are no longer prevented from rotating, they are taken along by the pretensioned coil springs 237, 237'. Since the brake rings 236, 236' are in addition fixedly seated on the shafts 221, 221', these shafts are taken along by the brake rings 236, 236'. In this manner, the gear wheels 220, 220', which are in engagement with the teeth 219, 219' of the toothed parts 204, 204' and are fixedly seated on the shafts 221, 221', are rotated.

In the position illustrated in FIG. 19, the top 201 is in its lowermost position. The gear wheels 220, 220' are resting against those ends of the cutout portions 217, 217' in the toothed parts 204, 204' that are remote from one another. The guide element 210 of the toothed part 204 rests against that end of the slot 209 in the vertical leg 206 of the mounting plate 201 that faces the gear wheel 220. If the gear wheels 220, 220' are rotated in the previously described manner, the toothed parts 204, 204' are then pivoted upwardly opposite to one another. In so doing, the toothed part 201' pivots about the shaft 247 with which that end of the toothed part 204' that is remote from the toothed part 204 is hinged to the vertical leg 206 of the mounting plate 201. At the same time, with this pivot movement the guide element 211' is shifted in the slot 212'. The other toothed part 204 similarly pivots upwardly, with the guide element 210 being shifted in the horizontal slot 209 of the vertical leg 206 of the mounting plate 201. Both of the toothed parts 204, 204' pivot uniformly, so that the height of the top 203 is adjusted horizontally. The gear wheels provided on the other (not illustrated) frame part are also rotated by the shafts 221, 221'. As soon as the desired height of the top 203 is obtained, the actuation shaft 239 is rotated in the opposite direction, as a result of which the clamping rings 238, 238' again tightly grasp the brake rings 236, 236', so that the shafts 221, 221' can no longer rotate. The actuation shaft 239 is supported on the furniture in a non-illustrated manner.

If the top 203 is to be tilted, the actuation shaft 239 is then first shifted axially in the desired direction, so that either the guide pin 245 or the guide pin 246 engages the corresponding coupling sleeve 241 or 242 respectively. The actuation shaft 239 is then rotated and the appropriate clamping ring 238 or 238' is loosened via the respectively engaged coupling sleeve 241 or 242. The respective shaft 221 or 221' with the pertaining gear wheel 220 or 220' is then rotated via the pretensioned coil spring 237 or 237'. In this way, only one of the two toothed parts 204, 204' is pivoted, as a result of which the top 203 is tilted.

In order to set or adjust the pretension of the respective coil spring for the tilting adjustment of the top 203, the actuation shaft 231 can be shifted axially in the desired direction, so that either the coupling element 235 or the coupling element 235' engages the spiral gear 230 or 230'. By rotating the actuation shaft 231, the respective coil spring 237, 237' is then pretensioned in the described manner with the brake rings 236, 236' being blocked.

The clamping rings 238, 238' are loosened during the adjustment process to such an extent that a satisfactory adjustment is assured.

The top 203 has its greatest tilt when the guide element 211 of the toothed part 204 abuts against that end of the slot 212 of the intermediate plate 213 that is remote from the toothed part 204'. As a result of the engagement of the gear wheels 220, 220' in the teeth 219, 219', the top 203 is reliably held in every tilted position. In this connection the top is supported on the frame part 202 via the toothed part 204, its guide element 210, and the mounting plate 201. In addition, the top 203 is also supported on the frame part via the shaft 247 of the toothed part 204' and the mounting plate 201. The uppermost end position of the part 203 is obtained when the guide elements 211, 211' of the toothed parts 204, 204' abut against those ends of the slots 217, 217' that are remote from one another.

The height of the top 203 can also be adjusted translatorily in a tilted position. For this purpose, it is merely necessary to return the actuation shaft 239 from its axially shifted position into the mid position illustrated in FIG. 18. If the actuation shaft 239 is then rotated, the two clamping rings 238, 238' are again loosened, so that subsequently the two gear wheels 220, 220' are rotated in opposite directions relative to one another in the described manner via the pretensioned coil springs, so that the two toothed parts 204, 204' are shifted in opposite directions in the described manner. In so doing, the top 203 is translatorily shifted in its respective tilted position.

Figures 21, 22, 23:
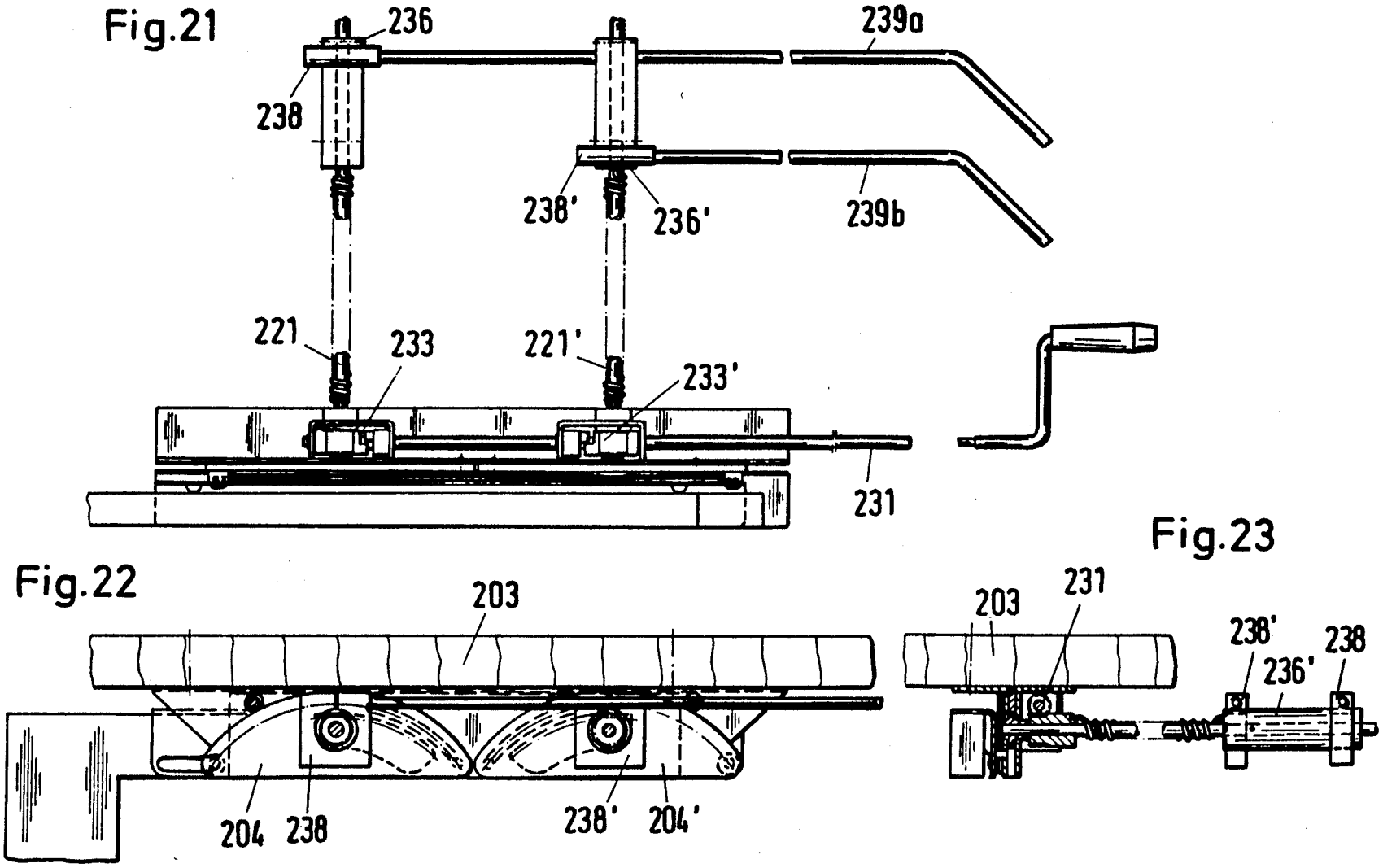

The embodiment illustrated in FIGS. 21 to 23 differs from the previously described embodiment merely in that separate actuation shafts 239*a*, 239*b* are provided for the brake rings 236, 236'. With these actuation shafts the clamping rings 238, 238' that are seated on the brake rings are actuated in the described manner. The brake rings 236, 236' can be considerably longer than in the previous embodiment. The brake rings are again rigidly connected with the shafts 221, 221'.

To adjust the top 203, the clamping rings 238, 238' are loosened by the actuation shafts 239*a*, 239*b*. Subsequently, the toothed parts 204, 204' are shifted in the described manner via the pretensioned coil springs. Since with this embodiment separate actuation shafts 239*a*, 239*b* are provided for the clamping rings 238 and 238', it is no longer necessary to axially shift the actuation shafts. If the top 203 is adjusted in height, the two actuation shafts 239*a* and 239*b* are rotated to loosen the clamping rings 238 and 238'. If the top 203 is to be tilted, either the actuation shaft 239*a* or 239*b* is then rotated, depending upon the direction of tilt. In other respects, the adjustment of the top 203 is effected in the same manner as with the embodiment of FIGS. 18 to 20. Since the actuation shafts 239*a*, 239*b* no longer have to be shifted axially, they can be embodied in a very simple manner and can also be simply connected to the clamping rings 238, 238'.

Figures 24, 25, 26:
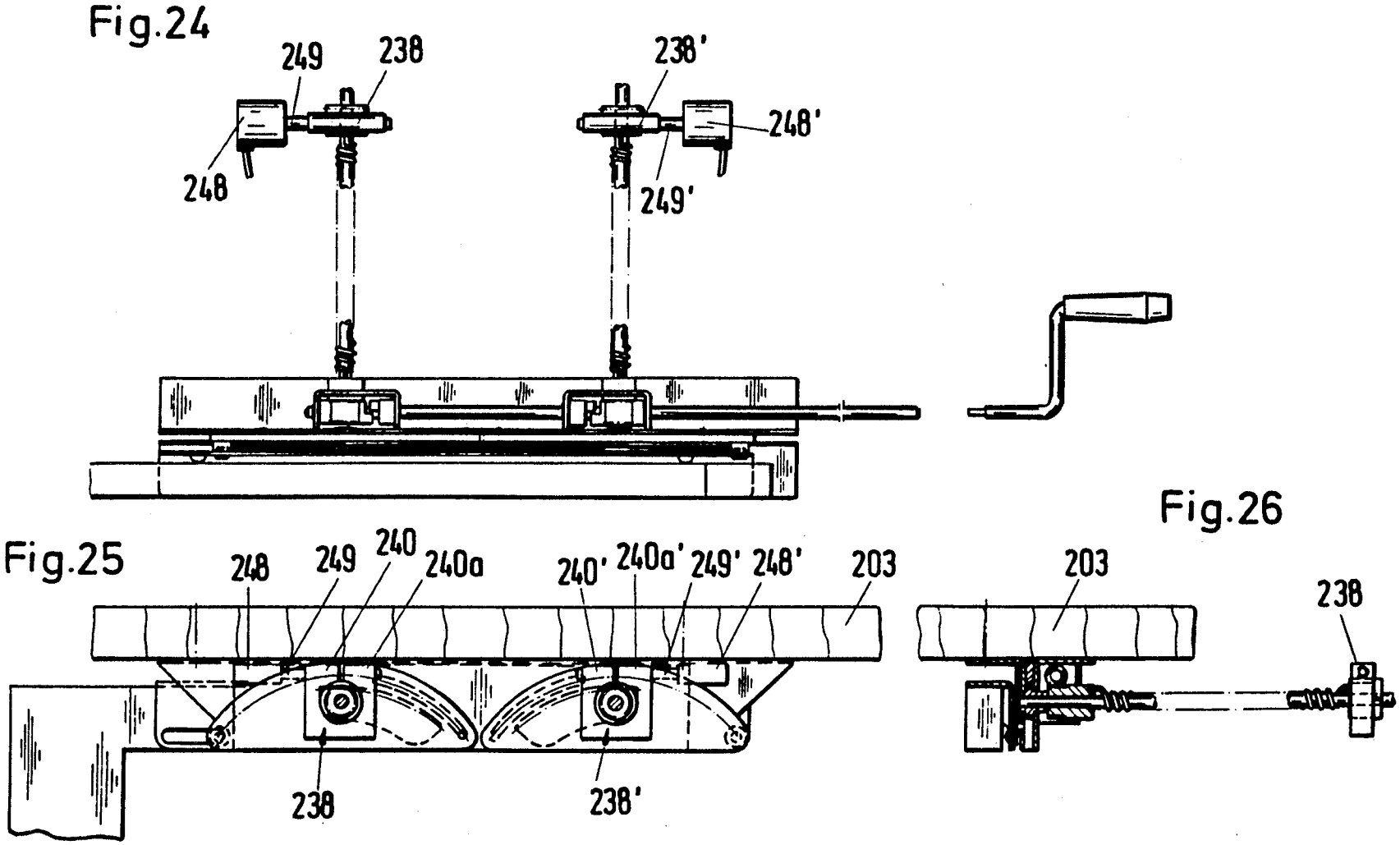

In the embodiment illustrated in FIGS. 24 to 26, in place of the actuation shafts for the clamping rings 238, 238', respective motorized drive mechanisms 248, 248' are provided. As motorized drive mechanisms, servomotors, operating magnets and the like can be provided that can be activated from that side of the furniture that faces the user. Each of the motorized drive mechanisms 248, 248' has a threaded spindle 249, 249' that engages the threaded bores of the ends 240, 240*a*, 240', 240*a*' of the clamping rings 238, 238'. In other respects, this embodiment is constructed in the same way as the embodiment of FIGS. 18 to 20. By means of the motorized drive mechanisms 248, 248', the clamping rings 238, 238' can be effortlessly actuated during adjustment of the top 203.

Figure 27:
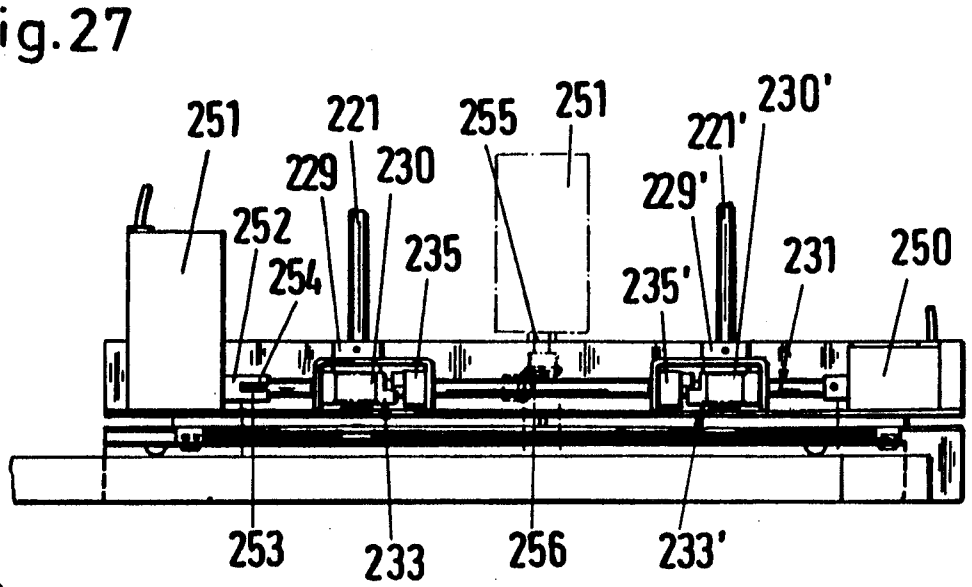
Figure 28:
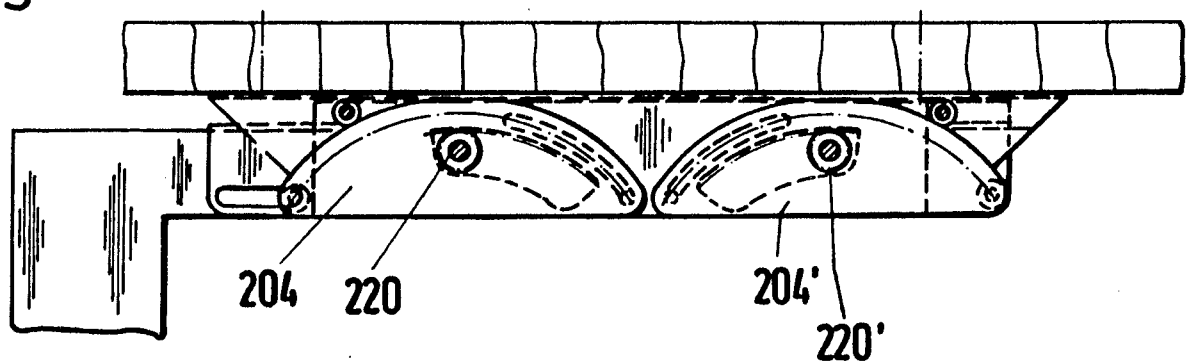
Figure 29:
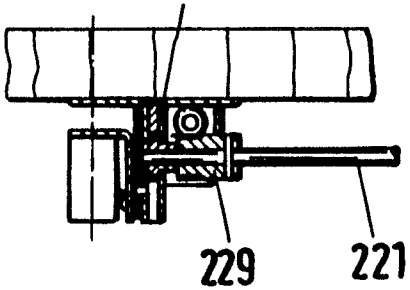

In the embodiment illustrated in FIGS. 27 to 29, the actuation shaft 231 is driven in a motorized manner and is axially shifted in a motorized manner. At one end, the actuation shaft 231 is connected with a motorized displacement drive mechanism 250 that is an adjustment member and with which the actuation shaft can be shifted axially. At the other end, the actuation shaft 231 is connected to a drive motor 251 with which the actuation shaft 231 can be rotated.

The drive motor 251 has a drive sleeve 252 into which the actuation shaft 231 extends. The drive sleeve 252 is provided with an axially extending slot 253 into which extends a guide pin 254 that projects radially from the actuation shaft. The length of the slot 253 is such, and the guide pin 254 is provided on the actuation shaft 231 in such a way, that the drive connection between the drive sleeve 252 and the actuation shaft 231 is assured in every axial position of the actuation shaft. Again seated on the actuation shaft 231 are the coupling elements 235, 235' that can be brought into engagement with the worm gears 230, 230' in the described manner.

With this embodiment, no coil springs are provided. Rather, the gear wheels, 220, 220' are directly rotatably driven by the spiral gears 229, 229', which are fixedly seated on the shafts 221, 221'. Depending upon the axial position of the actuation shaft 231, either both of the gear wheels 220, 220' or only one of them is rotatably driven, so that in conformity therewith either both toothed parts 204, 204' or only one toothed part is pivoted.

It is not necessary for the drive motor 251 to be disposed on an end of the actuation shaft 231. For example, as shown by dot-dash lines in FIG. 27, the drive motor can also be provided in the region between the two gear mechanisms 233, 233'. In this case, the drive shaft 255 of the drive motor 251 is drivingly connected with the actuation shaft 231 via a bevel gear 256 that permits axial movements of the actuation shaft.

In the described embodiments, the toothed parts could also be replaced by toothed racks that are curved in the shape of a partial circle.

The present invention is, of course, in no way restricted to the specific disclosure of the specification and drawings, but also encompasses any modifications within the scope of the appended claims.

I claim:

1. In a mechanism for adjusting the tilt and/or height of a countertop or table top of a piece of furniture, including at least one lifting element, which is connected to and acts on said countertop or table top and is connected to a drive gear mechanism disposed at a base portion of said piece of furniture, the improvement wherein:

said lifting element is a curved tooth element that is connected to said countertop and said base portion;

said drive gear mechanism includes a gear means that is in engagement with said toothed element;

guide means are provided at an underside of said countertop for guiding said toothed element; and said drive gear mechanism includes further gear means, with said first-mentioned gear means and said further gear means being spiral gears that mesh with one another and have axes of rotation that are disposed at right angles to one another.

2. In a mechanism for adjusting the tilt and/or height of a countertop or table top of a piece of furniture, including at least one lifting element, which is connected to and acts on said countertop or table top and is connected to a drive gear mechanism disposed at a base portion of said piece of furniture, the improvement wherein:

said lifting element is a curved tooth element that is connected to said countertop and said base portion;

said drive gear mechanism includes a gear means that is in engagement with said toothed element;

guide means are provided at an underside of said countertop for guiding said toothed element; and a synchronization means is provided, which includes a shaft that extends perpendicular to said toothed element and is connected to said drive gear mechanism.

3. In a mechanism for adjusting the tilt and/or height of a countertop or table top of a piece of furniture, including at least one lifting element, which is connected to and acts on said countertop or table top and is connected to a drive gear mechanism disposed at a base portion of said piece of furniture, the improvement wherein:

said lifting element is a curved tooth element that is connected to said countertop and said base portion;

said drive gear mechanism includes a gear means that is in engagement with said toothed element;

guide means are provided at an underside of said countertop for guiding said toothed element; and said drive gear mechanism includes a shaft stub that is fixedly connected with an intermediate shaft.

4. In a mechanism for adjusting the tilt and/or height of a countertop or table top of a piece of furniture, including at least one lifting element, which is connected to and acts on said countertop or table top and is connected to a drive gear mechanism disposed at a base portion of said piece of furniture, the improvement wherein:

said lifting element is a curved tooth element that is connected to said countertop and said base portion;

said drive gear mechanism includes a gear means that is in engagement with said toothed element;

guide means are provided at an underside of said countertop for guiding said toothed element;

said gear means is fixedly seated on shaft means of said drive gear mechanism; and a mounting plate is disposed at said base portion of said piece of furniture, on which mounting plate said toothed element is laterally guided.

5. An adjustment mechanism according to claim 4, in which said shaft means is rotatably mounted in said mounting plate.

6. In a mechanism for adjusting the tilt and/or height of a countertop or table top of a piece of furniture, including at least one lifting element, which is connected to and acts on said countertop or table top and is connected to a drive gear mechanism disposed at a base portion of said piece of furniture, the improvement wherein:

said lifting element is a curved tooth element that is connected to said countertop and said base portion;

said drive gear mechanism includes a gear means that is in engagement with said toothed element;

guide means are provided at an underside of said countertop for guiding said toothed element;

two toothed elements are provided that are disposed next to one another; and a mounting plate and a rail are provided, with said mounting plate being disposed at said base portion of said piece of furniture and with said rail being connected to said countertop or table top, with one end of one of said toothed elements being displaceably guided on said mounting plate, and the other end of said one toothed element being displaceably guided on said rail.

7. An adjustment mechanism according to claim 6, in which said one toothed element is provided with a guide element, and said mounting plate is provided with a slot that extends in the longitudinal direction thereof and in which said guide element extends.

8. An adjustment mechanism according to claim 6, in which said one toothed element is provided with a guide element, and in which said rail has a partially circular curved slot into which extends said guide element.

9. An adjustment mechanism according to claim 6, in which one end of the other of said toothed elements is displaceably guided on said rail, and the other end of said other toothed element is linked up to said mounting plate.

10. In a mechanism for adjusting the tilt and/or height of a countertop or table top of a piece of furniture, including at least one lifting element, which is connected to and acts on said countertop or table top and is connected to a drive gear mechanism disposed at a base portion of said piece of furniture, the improvement wherein:

said lifting element is a curved tooth element that is connected to said countertop and said base portion;

said drive gear mechanism includes a gear means that is in engagement with said toothed element;

guide means are provided at an underside of said countertop for guiding said toothed element;

two toothed elements are provided that are disposed next to one another; and said toothed elements are displaceable in opposite directions in an approximately synchronous manner.

11. In a mechanism for adjusting the tilt and/or height of a countertop or table top of a piece of furniture, including at least one lifting element, which is connected to and acts on said countertop or table top and is connected to a drive gear mechanism disposed at a base portion of said piece of furniture, the improvement wherein:

two toothed elements are provided that are disposed next to one another;

said toothed elements are guided between two bracket elements that are connected to an underside of said countertop; and an intermediate plate is provided that is connected to one of said bracket elements.

12. An adjustment mechanism according to claim 11, in which said intermediate plate is disposed between said one bracket element and a mounting plate.

13. An adjustment mechanism according to claim 12, in which said intermediate plate is displaceable in a vertical direction relative to said one bracket element and said mounting plate.

14. An adjustment mechanism according to claim 11, in which said one bracket element is provided with at least two engagement elements that engage slots of said intermediate plate.

15. An adjustment mechanism according to claim 14, in which said slots extend in a vertical direction of said intermediate plate.

16. An adjustment mechanism according to claim 11, in which said intermediate plate has a lower position in which it rests upon a guide element of one of said toothed elements and upon a link member of the other one of said toothed elements.

17. In a mechanism for adjusting the tilt and/or height of a countertop or table top of a piece of furniture, including at least one lifting element, which is connected to and acts on said countertop or table top and is connected to a drive gear mechanism disposed at a base portion of said piece of furniture, the improvement wherein:

said lifting element is a curved toothed element that is connected to said countertop and said base portion;

said drive gear mechanism includes a gear means that is in engagement with said toothed element;

guide means are provided at an underside of said countertop for guiding said toothed element;

two toothed elements are provided that are disposed next to one another; and an actuation shaft is provided that is operatively connectable and disconnectable to drive gear mechanism means of one of said toothed elements via a coupling.

18. In a mechanism for adjusting the tilt and/or height of a countertop or table top of a piece of furniture, including at least one lifting element, which is connected to and acts on said countertop or table top and is connected to a drive gear mechanism disposed at a base portion of said piece of furniture, the improvement wherein:

said lifting element is a curved toothed element that is connected to said countertop and said base portion;

said drive gear mechanism includes a gear means that is in engagement with said toothed element;

guide means are provided at an underside of said countertop for guiding said toothed element;

two toothed elements are provided that are disposed next to one another; and each toothed element has associated therewith a drive gear mechanism having further gear means; which includes an actuation shaft; and which includes two coupling elements that are seated on said actuation shaft, with said coupling elements being adapted to be selectively coupled with said further gear means of one or both of said drive gear mechanism via axial displacement of said actuation shaft.

19. An adjustment mechanism according to claim 18, in which a driving connection to said first-mentioned gear means includes as a force transmitting means at least one coil spring.

20. An adjustment mechanism according to claim 18, in which said drive gear mechanism includes a worm gear that meshes with said further gear means; and which includes for each coil spring a connecting shaft, whereby one end of said coil spring is fixedly secured to said worm gear, and the other end of said coil spring is fixedly secured to a brake ring.

21. An adjustment mechanism according to claim 20, in which said worm gear is rotatably seated on said connecting shaft.

22. An adjustment mechanism according to claim 20, in which seated on each brake ring is a respective clamping ring that is adapted to tightly hold said brake ring.

23. An adjustment mechanism according to claim 22, which includes an actuation rod for moving said clamping ring out of a clamping position and into a release position, and vice versa.

24. An adjustment mechanism according to claim 22, which includes motorized drive means for moving said clamping ring out of a clamping position and into a release position, and vice versa.

25. An adjustment mechanism according to claim 20, in which said coil spring surrounds said connecting shaft.

26. An adjustment mechanism according to claim 20, in which each of said brake rings is adapted to be held tightly by a clamping ring.

27. An adjustment mechanism according to claim 26, which includes a common actuation rod for displacing both of said clamping rings.

28. An adjustment mechanism according to claim 27, which includes at least one coupling means disposed between said clamping rings, with said actuation rod being adapted to be selectively coupled with one or both of said clamping rings via said coupling means.

29. An adjustment mechanism according to claim 28, in which said coupling means comprises pin means that extend at right angles from said actuation rod and, in a coupling state, engage in slot means of counter coupling means of said clamping rings.

30. An adjustment mechanism according to claim 26, which includes a separate actuation rod for each of said clamping rings.

31. An adjustment mechanism according to claim 18, which includes drive means for axially displacing said actuation shaft.

32. An adjustment mechanism according to claim 18, which includes a drive motor for rotating said actuation shaft.

* * * * *